US008601621B2

(12) United States Patent
Aprile et al.

(10) Patent No.: US 8,601,621 B2
(45) **Date of Patent: *Dec. 10, 2013**

(54) SEMI-FITTED BLANKET AND METHOD OF MANUFACTURING SAME

(71) Applicants: Rita Aprile, Millstone, NJ (US); Caterina Angelicola, Howell, NJ (US)

(72) Inventors: Rita Aprile, Millstone, NJ (US); Caterina Angelicola, Howell, NJ (US)

(73) Assignee: Effortless Bedding LLC, Freehold, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/662,643

(22) Filed: Oct. 29, 2012

(65) Prior Publication Data

US 2013/0047337 A1 Feb. 28, 2013

Related U.S. Application Data

(63) Continuation-in-part of application No. 11/849,792, filed on Sep. 4, 2007, now Pat. No. 8,336,137.

(60) Provisional application No. 61/552,400, filed on Oct. 27, 2011.

(51) Int. Cl.
*A47G 9/04* (2006.01)

(52) U.S. Cl.
USPC ..... 5/497; 5/495; 5/498; 5/499

(58) Field of Classification Search
USPC ..... 5/497, 482, 485, 498, 483, 486, 493, 5/499, 494–496
See application file for complete search history.

(56) References Cited

U.S. PATENT DOCUMENTS

| | | | | | |
|---|---|---|---|---|---|
| 2,757,389 | A | | 8/1956 | King | |
| 3,868,735 | A | | 3/1975 | Ross | |
| 3,962,739 | A | * | 6/1976 | Crockett | 5/497 |
| 4,021,869 | A | | 5/1977 | Root | |
| 4,245,365 | A | * | 1/1981 | Large | 5/496 |
| 5,027,460 | A | * | 7/1991 | Honig | 5/497 |
| 5,165,128 | A | * | 11/1992 | Honig | 5/497 |
| 5,189,744 | A | * | 3/1993 | Roberts | 5/497 |
| 5,465,440 | A | * | 11/1995 | Heptner | 5/497 |

(Continued)

FOREIGN PATENT DOCUMENTS

FR 2 859 087 3/2005

OTHER PUBLICATIONS

Form PCT/ISA/220, "Notification of Transmittal of the International Search Report and the Written Opinion of the International Searching Authority . . . ", Mailed Jun. 20, 2008 for PCT/US2008/067586, 3 pages.

(Continued)

*Primary Examiner* — William Kelleher
(74) *Attorney, Agent, or Firm* — Jon Fallon, Esq.

(57) ABSTRACT

Embodiments of the present disclosure generally relate to a semi-fitted blanket and methods thereof. In exemplary embodiments, a semi-fitted blanket is provided that may comprise a fitted portion, defined by a distal end and a first and second side edge of the blanket, comprising a securing means incorporated along an outer edge of the blanket, along a perimeter of the fitted portion, and a remainder of the fitted portion, being free of seams and stitching for purposes of fitting to the contour of a mattress; and a non-fitted portion, defined by an end of the blanket opposing the distal end.

18 Claims, 4 Drawing Sheets

(56) References Cited

U.S. PATENT DOCUMENTS

| | | | | |
|---|---|---|---|---|
| 6,041,456 | A * | 3/2000 | Pharr | 5/497 |
| 6,061,851 | A * | 5/2000 | Crowell | 5/497 |
| 2004/0200000 | A1* | 10/2004 | Harbin et al. | 5/497 |
| 2005/0071924 | A1* | 4/2005 | Ratigan | 5/497 |
| 2005/0193490 | A1* | 9/2005 | Macdonald | 5/500 |
| 2007/0174963 | A1* | 8/2007 | Howard | 5/497 |

OTHER PUBLICATIONS

Form PCT/ISA/237, "Wirtten Opinion of the International Searching Authority", Mailed Jun. 20, 2008 for PCT/US2008/067586, 4 pages.
Form PCT/ISA210, "International Search Report", Mailed Jun. 20, 2008 for PCT/US2008/067586, 3 pages.

* cited by examiner

100

SEMI-FITTED BLANKET AND METHOD OF MANUFACTURING SAME

CROSS-REFERENCE TO RELATED APPLICATIONS

This application is a continuation-in-part of U.S. patent application Ser. No. 11/849,792, filed Sep. 4, 2007, entitled "Semi-Fitted Bedsheet and Method of Manufacturing Same," and claims priority to U.S. provisional patent application Ser. No. 61/552,400, filed Oct. 27, 2011, entitled "Semi-Fitted Blankets and Methods of Manufacturing Same," the disclosures of which are incorporated by reference herein in their entireties.

BACKGROUND

1. Field of the Invention

Embodiments of the present disclosure generally relate to a semi-fitted blanket and methods thereof. More specifically, embodiments of the present disclosure relate to a blanket comprising a non-fitted portion and a fitted portion for securing the blanket onto one end of a mattress, and a method for manufacturing the same.

2. Description of the Related Art

Traditional blankets consist of a single sheet or a layered sheet including an insulating material that may be draped over a mattress. After moving beneath a typical blanket, during the course of sleeping, a restless sleeper may toss and turn and, as a result, pull at least a portion of the blanket to a different location on the mattress. Blankets can often become bunched on one side of a mattress. In the case of multiple sleepers in a bed, one sleeper may pull the blanket from its loosely draped position to a single side, thereby reducing and/or eliminating the benefit of the blanket to the other user. Thus, there is a need for an improved semi-fitted blanket for substantially securing the blanket to a mattress.

SUMMARY

Embodiments of the present disclosure generally relate to a semi-fitted blanket and methods thereof. In exemplary embodiments, a semi-fitted blanket may include a fitted portion, defined by a distal end and a first and second side edge of the blanket, comprising a securing means incorporated along an outer edge of the blanket, along a perimeter of the fitted portion, and a remainder of the fitted portion, being free of seams and stitching for purposes of fitting to the contour of a mattress; and a non-fitted portion, defined by an end of the blanket opposing the distal end.

In another embodiment of the present disclosure, a method for making a semi-fitted blanket may include providing a blank of material, making a single cut along a first end of the blank of material, creating at least a position indicator in the blank of material, and incorporating a securing means along an edge of the first end of the blank of material.

In another embodiment of the present disclosure, a semi-fitted blanket may include a fitted portion, defined by a distal end and a first and second side edge of the blanket, having an elastic material incorporated along in a channel along an outer edge of the blanket, along a perimeter of the fitted portion, and a remainder of the fitted portion is free of seams and stitching for purposes of fitting to the contour of a mattress; a non-fitted portion, defined by an end of the blanket opposing the distal end; and a dart for identifying a proper positioning of the blanket on a mattress.

In yet another embodiment of the present disclosure, a semi-fitted blanket may include a fitted portion, defined by a distal end and a first and second side edge of the blanket, comprising an elastic material incorporated along in a hemmed channel along an outer edge of the blanket, along a perimeter of the fitted portion and anchored using a plurality of threads stitched into a first and second end of the elastic material and through the fitted portion, and a remainder of the fitted portion, free of seams and stitching for purposes of fitting to the contour of a mattress; and a non-fitted portion, defined by an end of the blanket opposing the distal end; and a plurality of darts for aligning the semi-fitted blanket with corners on a mattress.

BRIEF DESCRIPTION OF THE DRAWINGS

So the manner in which the above recited features of the present disclosure can be understood in detail, a more particular description of embodiments of the present disclosure, briefly summarized above, may be had by reference to embodiments, which are illustrated in the appended drawings. It is to be noted, however, the appended drawings illustrate only typical embodiments of embodiments encompassed within the scope of the present disclosure, and, therefore, are not to be considered limiting, for the present disclosure may admit to other equally effective embodiments, wherein.

Figure 1:
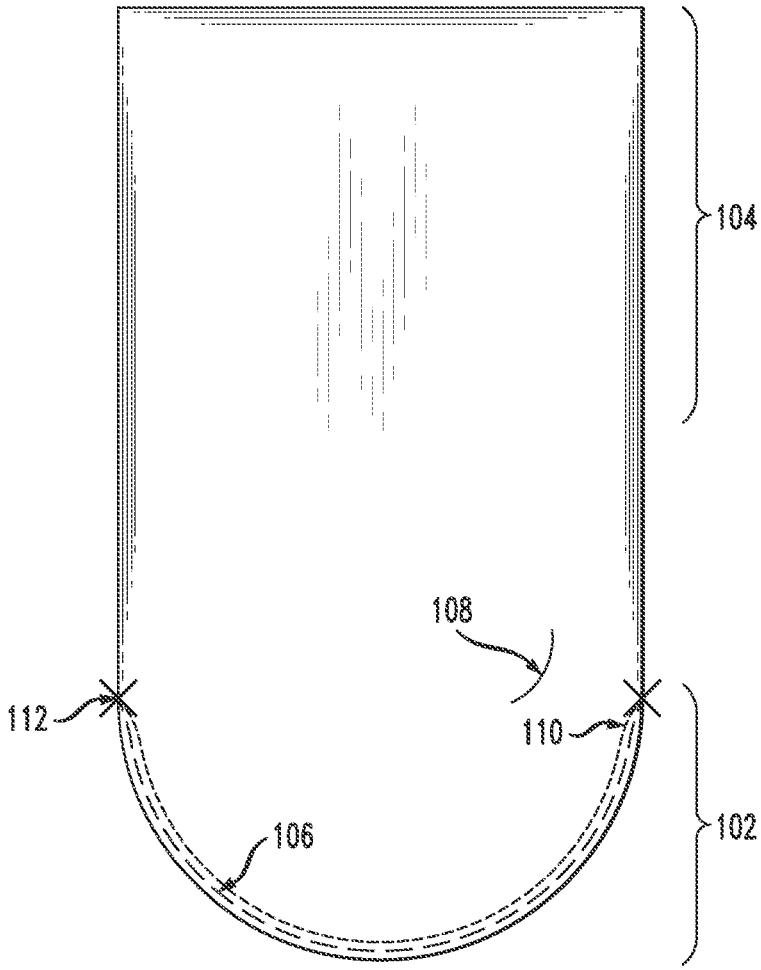
FIG. 1 depicts a top view of a semi-fitted blanket in accordance with one embodiment of the present disclosure.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present disclosure generally relate to a semi-fitted blanket and method thereof. More specifically, embodiments of the present disclosure relate to a blanket comprising a non-fitted portion and a fitted portion for securing the blanket onto one end of a bed.

While many embodiments of the present disclosure are directed towards blankets, additional embodiments of the present disclosure may be directed towards similar articles, such as comforters, duvet, quilts, coverlets, throws, bedspreads, electric blankets, semi-fitted bedsheets, or the like. For purposes of embodiments of the present invention, the use of the term "blanket," or variants thereof, shall be inclusive of all forms of such textile articles.

FIG. 1 depicts a top view of a semi-fitted blanket in accordance with one embodiment of the present disclosure. Embodiments of the present disclosure comprise a semi-fitted blanket 100. Generally, the semi-fitted blanket comprises a fitted portion 102 and a non-fitted portion 104. The non-fitted portion 104 of the blanket 100 is analogous to a conventional blanket, being substantially unobstructed or non-aesthetically modified. Generally, in accordance with embodiments of the present disclosure, the blanket 100 comprises at least one of cotton, polyester, silk, wool, linen, flannel material, and/or the like. The blanket 100 may comprise materials suitable for embodiments of the present disclosure, for example, natural fibers, synthetic fibers, woven materials, nonwoven materials, elastic materials, semi-elastic materials, fleece, microfleece, microfiber, and/or the like. In many embodiments, the blanket 100 may comprise fire retardant materials. In many embodiments, the blanket 100 may further comprise a fabric material, having a stuffing and/or insulating material (e.g., feathers, cotton, silk, wool, combinations of fibers, etc.) therein, as in a traditional comforter.

The fitted portion 102 of embodiments of the present disclosure is seamless, such that no seams or stitching, for purposes of fitting to the contour of a mattress and/or bedding (e.g., to conform to the right angles of a corner of a mattress), are provided. Moreover, embodiments of the present disclosure are generally designed independent of the thickness of the mattress such that a blanket in accordance with embodiments of the present disclosure may accommodate a standard mattress as well as an extra deep mattress, as well as different lengths and widths of mattresses. Further, a blanket 100 in accordance with exemplary embodiments of the present disclosure may be adapted to fit over different types and/or thicknesses of typical bedding on a mattress and accommodate mattresses of different sizes. Embodiments of the present disclosure are generally designed independent of the thickness of any bedding and/or padding present on a mattress such that a blanket in accordance with embodiments of the present disclosure may accommodate fitted sheets, flat sheets, mattress pads, pillows, pillow covers, secondary blankets, and/or the like.

The fitted portion 102 generally comprises a securing means 106 to secure the blanket 100 to at least one end of a mattress (not shown). The securing means 106 is generally positioned along an edge of the fitted portion 102 of the blanket 100. In one embodiment, the securing means 106 comprises a strip of elastic material. In another embodiment, the securing means 106 comprises at least one of natural rubber fibers, synthetic rubber fibers, spandex fibers, or the like.

In many embodiments, a channel 110 is provided along an edge of the fitted portion 102 of the blanket 100. In one embodiment, the channel 110 is formed from a hem, as a section of material is folded over itself and stitched shut to create a channel 110. It is understood by embodiments of the present disclosure, the formation of a channel 110 in such a manner does not interfere with the seamlessness of the fitted portion 102, whereas the channel 110 is not for purposes of fitting to the contour of a mattress.

In certain embodiments, the securing means 106 may be housed within the channel 110, and secured via an anchoring stitch 112 at each end of the channel 110. In another embodiment, the securing means 106 may be interwoven into the material of blanket 100 itself. For example, where spandex fibers are provided as a securing means 106, the spandex fibers may be woven into the woven fabric of the blanket 100, along an edge of the fitted portion 102. In an alternative embodiment, the securing means 106 may be affixed to an edge of the fitted portion 102. For example, where a strip of natural or synthetic rubber fibers or fabric are provided as a securing means 106, the strip of natural or synthetic rubber fibers or fabric are affixed, via an adhesive, stitching, or the like, to an outermost edge of the fitted portion 102 of the blanket 100.

Embodiments of the present disclosure optionally comprise a position indicator 108. In accordance with embodiments of the present disclosure, the position indicator 108 may indicate the position visually, palpably, or audibly to the user. In one embodiment of the present disclosure, the position indicator 108 comprises a piece of fabric substantially different from the material composition of the blanket 100. For example, in one embodiment, the blanket 100 may comprise a cotton blend material and the position indicator 108 comprises a felt or plush material. In another embodiment, the position indicator 108 comprises a dart. For the purpose of this patent application, the term "dart" is intended to mean a stitch which directs an article of fabric to conform to the contours of the body to which it is fit.

Figure 2:
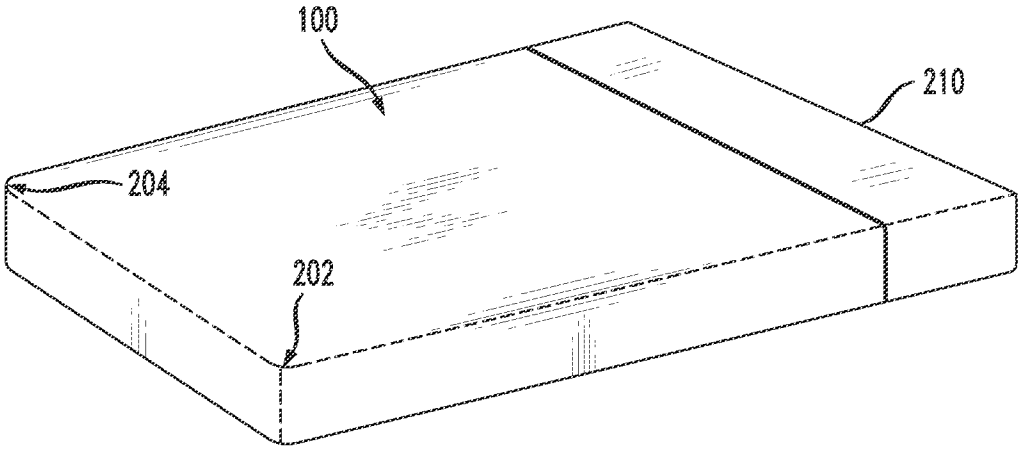
FIG. 2 depicts a perspective view of a semi-fitted blanket in operation in accordance with one embodiment of the present disclosure.

FIG. 2 depicts a perspective view of a semi-fitted blanket in operation in accordance with one embodiment of the present disclosure. In one embodiment, a dart 202 is used as a position indicator to indicate to the user the relative position of the blanket 100 on a mattress 210. As the semi-fitted blanket 100 is positioned on the mattress 210, the position of the dart 202 coincides with the corresponding corner of the mattress 210. In accordance with another embodiment of the present disclosure, the semi-fitted blanket comprises a second position indicator 204.

Other embodiments provide a position indicator 108 comprising substantially the same material as the blanket 100, and having a substantially different color or pattern. In yet another embodiment, the position indicator 108 comprises a sensor. In such an embodiment, the sensor may emit a sound or other signal to notify an individual, particularly an individual with a visual impairment, of the location of the position indicator 108.

Figure 3A:
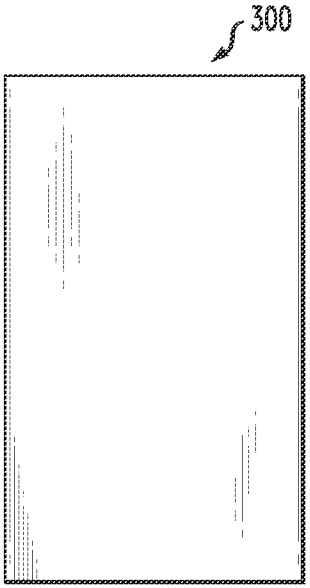
FIGS. 3A-3E depict a method of manufacturing a semi-fitted blanket in accordance with one embodiment of the present disclosure.
Figure 3B:
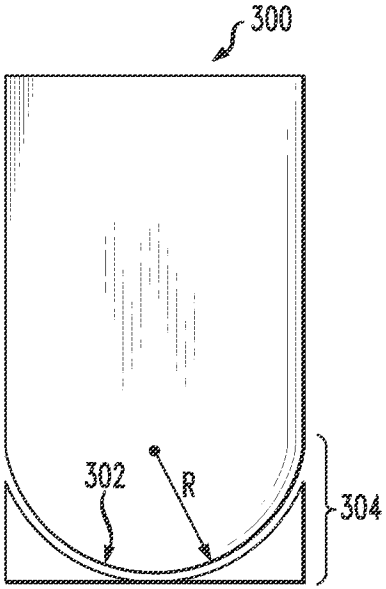

Referring now to FIGS. 3A-3B, one method for manufacturing the semi-fitted blanket in accordance with embodiments of the present disclosure is disclosed in a step-by-step process. As generally understood by those of ordinary skill in the art, this method may be performed in any logical order, and should not be limited by the order of the steps discussed herein.

As shown in FIG. 3A, a method comprises providing a rectangular blank of material 300. As shown in FIG. 3B, a single cut 302 is made along a first end 304 of the rectangular blank of material 300. In accordance with embodiments of the present disclosure, this cut 302 is a single, continuous cut having either a constant radius of curvature or a variable radius of curvature R.

Figure 3C:
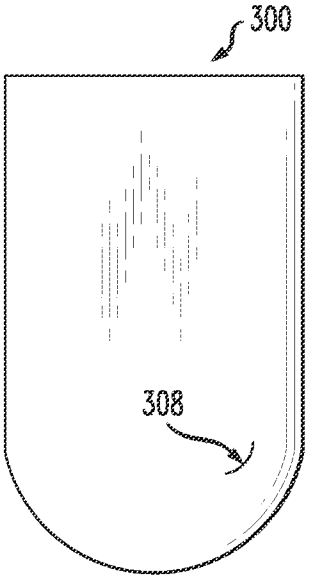

Referring now to FIG. 3C, a position indicator 308 may be created in the blank of material. In one embodiment of the present disclosure, the creation of a position indicator 308 comprises stitching a plurality of fibers or a continuous fiber along an arc or angle into the blank of material 300. The location of the position indicator 308 may be determined by the size of the blank of material 300 and/or the size or intended size of a mattress on which a blanket in accordance with embodiments of the present disclosure should be utilized.

Figure 3E:
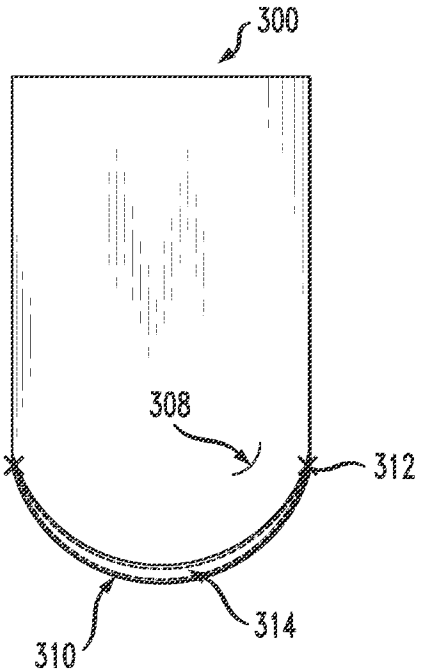
Figure 3D:
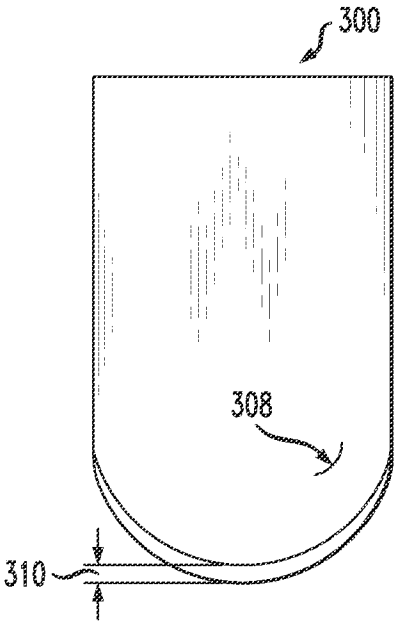

In FIG. 3D, a channel 310 may be formed along an edge of the first end 304 of the blank of material 300. In one embodiment, the channel 310 may be formed by creating a hem along a fold in the blank of material along the edge of the first end 304. In accordance with embodiments of the present disclosure, as shown in FIG. 3E, a securing means 314 is incorporated into the channel 310 to provide expandability and resilience to the edge of the first end 304 of the blank of material 300. In one embodiment, the securing means 314 is anchored to a first end and second end of the channel 310 via anchoring stitches 312. Optionally, a plurality of anchoring stitches may be provided along the securing means 314, and through the channel 310, to provide stability to the first end, and in certain embodiments, may prevent the securing means 314 from snapping or breaking.

In certain embodiments, when further layers and/or stuffing are desired, the process may be repeated for a second blank of material (not shown) and a stuffing layer may be added between the first and second blanks after the cut is made and/or the first and second blanks are coupled together. Alternatively, multiple blanks may be cut at the same time. In exemplary embodiments, additional blanks may also be included in the blanket. Generally, multiple blanks may be coupled together by typical blanket securing methods, for example, by a stitching around the perimeter and/or running through the surface of the blanks, or the like. The stuffing may be added by typical methods of adding blanket stuffing, or the like. In some embodiments, multiple blanks, such as a first and second blank, may comprise a channel 310, a securing means 314, and/or anchoring stitches 312 as described above. Alternatively, in some embodiments, one blank may include the channel 310, securing means, and/or anchoring stitches 312 and additional blanks may not include the channel 310, securing means 314, and/or anchoring stitches 312. In some embodiments, the channel 310, securing means 314, and/or anchoring stitches 312 may be formed between two or more layers of blanks.

It should be emphasized that the above-described embodiments of the present disclosure are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

Now that exemplary embodiments of the present disclosure have been shown and described in detail, various modifications and improvements thereon will become readily apparent to those skilled in the art.

It will be understood that one or more of the steps described can be rearranged, separated, and/or combined without deviating from the scope of embodiments of the disclosure. For ease, steps are, at times, presented sequentially. This is merely for ease and is in no way meant to be a limitation.

Further, it will be understood that one or more of the elements and/or exemplary embodiments of the disclosure described can be rearranged, separated, and/or combined without deviated from the scope of the disclosure. For ease, various elements are described, at times, separately. This is merely for ease and is in no way meant to be a limitation.

While the various steps, elements, and/or exemplary embodiments of the disclosure have been outlined above, it is evident that many alternatives, modifications and variations will be apparent to those skilled in the art. The various steps, elements, and/or exemplary embodiments of the disclosure, as set forth above, are intended to be illustrative, not limiting. Various changes can be made without departing from the spirit and scope of the disclosure. Accordingly, the spirit and scope of the present disclosure is to be construed broadly and not limited by the foregoing specification.

No element, act, or instruction used in the description of the present application should be construed as critical or essential to the disclosure unless explicitly described as such. Also, as used herein, the article "a" is intended to include one or more items. Where only one item is intended, the term "one" or similar language is used.

Further, the terms "any of" followed by a listing of a plurality of items and/or a plurality of categories of items, as used herein, are intended to include "any of," "any combination of," "any multiple of," and/or "any combination of multiples of" the items and/or the categories of items, individually or in conjunction with other items and/or other categories of items. In addition, as used herein, the term "set" is intended to include any number of items, including zero. Further, as used herein, the term "number" is intended to include any number, including zero.

What is claimed is:

1. A semi-fitted blanket comprising:

a fitted portion, defined by a distal end and a first and second outermost side edge of the blanket, the first and second outermost side edges being inclusive of the widest edges of the entire blanket, comprising:

a securing means along a continuously convex outer edge of the blanket, along a perimeter of the fitted portion, and a remainder of the fitted portion being free of seams, free of cuts, and free of stitching for purposes of fitting to the contour of a mattress; and a non-fitted portion, defined by an end of the blanket opposing the distal end.

2. The semi-fitted blanket of claim 1, further comprising a position indicator for identifying a proper positioning of the blanket on a mattress.

3. The semi-fitted blanket of claim 2, wherein the position indicator comprises a dart.

4. The semi-fitted blanket of claim 2, wherein the position indicator comprises at least one of a sensor or a piece of fabric material substantially different from the material of the blanket.

5. The semi-fitted blanket of claim 2, further comprising at least a plurality of position indicators.

6. The semi-fitted blanket of claim 1, wherein the blanket comprises at least one of cotton, polyester, wool, or flannel.

7. The semi-fitted blanket of claim 1, wherein the securing means comprises an elastic material.

8. The semi-fitted blanket of claim 7, wherein the strip of elastic material comprises a plurality of at least one of natural rubber, synthetic rubber, or spandex fibers.

9. The semi-fitted blanket of claim 1, wherein the securing means is housed in a channel along the edge of the fitted portion.

10. The semi-fitted blanket of claim 9, wherein the securing means is anchored to at least a first end and a second end of the channel.

11. The semi-fitted blanket of claim 10, wherein the securing means is anchored using a plurality of threads stitched into the securing means and through the fitted portion.

12. The semi-fitted blanket of claim 9, wherein the channel is formed from a hem along the edge of the fitted portion.

13. A semi-fitted blanket comprising:

a fitted portion, defined by a distal end and a first and second outermost side edge of the blanket, the first and second outermost side edges being inclusive of the widest edges of the entire blanket, having an elastic material incorporated along a continuously convex outer edge of the blanket, along a perimeter of the fitted portion, and a remainder of the fitted portion is free of seams, free of cuts, and free of stitching for purposes of fitting to the contour of a mattress;

a non-fitted portion, defined by an end of the blanket opposing the distal end; and a dart for identifying a proper positioning of the blanket on a mattress.

14. The semi-fitted blanket of claim 13, further comprising at least a plurality of darts.

15. The semi-fitted blanket of claim 13, wherein the blanket comprises at least one of cotton, polyester, wool, or flannel.

16. The semi-fitted blanket of claim 13, wherein elastic material is anchored using a plurality of threads stitched into a first and second end of the elastic material and through the fitted portion.

17. A semi-fitted blanket comprising:

a fitted portion, defined by a distal end and a first and second outermost side edge of the blanket, the first and second outermost side edges being inclusive of the widest edges of the entire blanket, comprising:

an elastic material incorporated along in a hemmed channel along a continuously convex outer edge of the blanket, along a perimeter of the fitted portion and anchored using a plurality of threads stitched into a first and second end of the elastic material and through the fitted portion, and a remainder of the fitted portion, free of seams, free of cuts, and free of stitching for purposes of fitting to the contour of a mattress; and a non-fitted portion, defined by an end of the blanket opposing the distal end; and a plurality of darts for aligning the semi-fitted blanket with corners on a mattress.

18. The semi-fitted blanket of claim 17, wherein the blanket comprises at least one of cotton, polyester, wool, flannel or combinations thereof.

* * * * *